United States Patent [19]

Clarke et al.

[11] Patent Number: 5,014,789

[45] Date of Patent: May 14, 1991

[54] METHOD FOR STARTUP OF PRODUCTION IN AN OIL WELL

[76] Inventors: Neville Clarke, Unit 4, 481 Princes Highway, Narre Warren, 3805, Victoria; Thomas H. Winter, Unit 3, 21/27 St. Vincent Street, Albert Park, 3206, Victoria, both of Australia

[21] Appl. No.: 299,831

[22] PCT Filed: Jul. 7, 1987

[86] PCT No.: PCT/AU87/00201

§ 371 Date: Feb. 27, 1989

§ 102(e) Date: Feb. 27, 1989

[87] PCT Pub. No.: WO88/00277

PCT Pub. Date: Jan. 14, 1988

[30] Foreign Application Priority Data

Jul. 7, 1986 [AU] Australia ..... PH6777/86

[51] Int. Cl.[5] ..... E21B 43/12; E21B 43/18

[52] U.S. Cl. ..... 166/372; 166/53; 417/54; 417/108

[58] Field of Search ..... 166/372, 53, 250; 417/54, 57, 110, 113, 300, 108; 137/486

[56] References Cited

U.S. PATENT DOCUMENTS

| | | | |
|---|---|---|---|
| 1,856,872 | 5/1932 | Kogan | 166/53 |
| 2,423,944 | 7/1947 | Moore | 166/53 |
| 2,951,451 | 9/1960 | Vincent | 417/54 |
| 3,203,351 | 8/1965 | Gillis | 417/57 |
| 3,678,997 | 7/1972 | Barchard | 166/53 |
| 3,908,761 | 9/1975 | Patterson et al. | 166/372 |
| 4,267,885 | 5/1981 | Sanderford | 166/372 |
| 4,685,522 | 8/1987 | Dixon et al. | 166/372 |
| 4,708,595 | 11/1987 | Maloney et al. | 166/372 |
| 4,738,313 | 4/1988 | McKee | 166/53 |
| 4,815,536 | 3/1989 | Prendergast et al. | 166/53 |

*Primary Examiner*—Bruce M. Kisliuk
*Attorney, Agent, or Firm*—Ladas & Parry

[57] ABSTRACT

A method of startup of oil production in a gas-lift well in which inlet flow (22) of gas is controlled (46, 42) while means (34, 28) controlling fluid flow from the well is progressively opened. Preferably, fluid flow rate from the well is monitored and valve means (28) opening rate reduced on detection of a greater than predetermined increase in flow rate. A method of controlling the oil production is also provided wherein flow rate from the well is monitored and a flow regulating device (28) in the flow path from the well controlled in accordance with that monitored flow rate which is indicative of the onset of slugging.

6 Claims, 3 Drawing Sheets

METHOD FOR STARTUP OF PRODUCTION IN AN OIL WELL

This invention relates to a method for startup of production in an oil well, and, more generally, to a method of control of oil production.

The production fluid recovered from an oil well normally comprises a mixture of oil products, water and gas in varying proportions. Under some circumstances, in order to facilitate flow to the surface, a suitable gas is injected into the well production casing, such as towards its lower end, whereby to be entrained in the production liquid. This has the effect of reducing the effective density of the fluid whereby to improve flow to the surface. When starting up production in a well where this gas lift technique is used , some difficulty may arise in that the gas as admitted, may instead of being homogenously entrained in the production fluid, "break out" and form large discrete regions of gas within the well casing. The phenomenon known as "slugging", whereby irregular flow of production fluid from the well occurs, will then arise. This irregular flow is due to alternating flows of gas and production of fluid from the well. Generally, this phenomenon arises because too much gas is injected relative to the quantity of production fluid flowing up the well production casing. Slugging is an undesirable phenomenon since it results in waste of gas, which may be in relatively short supply Slugging also disrupts the orderly processing of the production fluid and may lead to damage to the oil reservoir. Furthermore, if the balance of gas is too great the entire flow of fluid may be cut off.

In one aspect, the invention has for its object to provide a method to startup of oil production in an oil well which lessens the possibility of occurrence of slugging.

In one aspect, the invention provides a method of startup of oil production in an oil well, wherein gas is injected into the well fluid to be recovered whereby to facilitate lifting of the fluid, characterised in that while controlling the inlet flow of the said gas, valve means controlling fluid flow from the well is progressively opened. Preferably, the flow rate of fluid from the well is monitored and the rate of opening of the valve means is varied whereby to reduce the rate of opening on detection of an increase in flow rate which is greater than a predetermined rate. The inlet flow of the gas may be maintained substantially constant.

The invention also provides a method of controlling oil production in an oil well using gas injection to facilitate lifting, wherein the flow rate of fluid from the well is monitored and a flow regulating device in the flow path from the well is controlled in accordance with the monitored flow rate to reduce the flow rate when the flow rate, as monitored, is indicative of onset of slugging, such as when an increase in flow rate is detected.

The invention is further described by way of example only with reference to the accompanying drawings in which.

Figure 1:
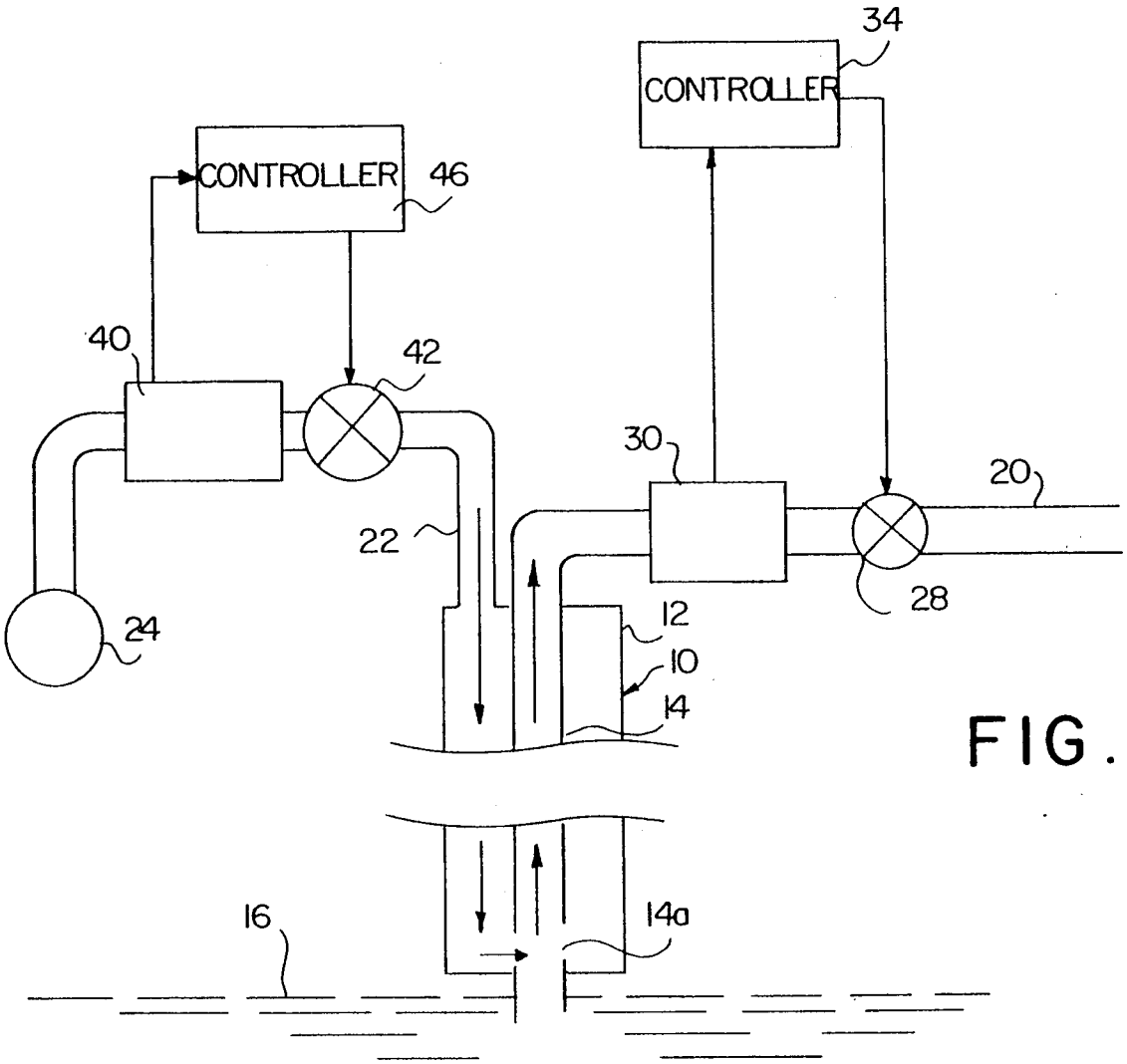
FIG. 1 is a diagram of an oil well adapted for practising the present invention.
Figure 2:
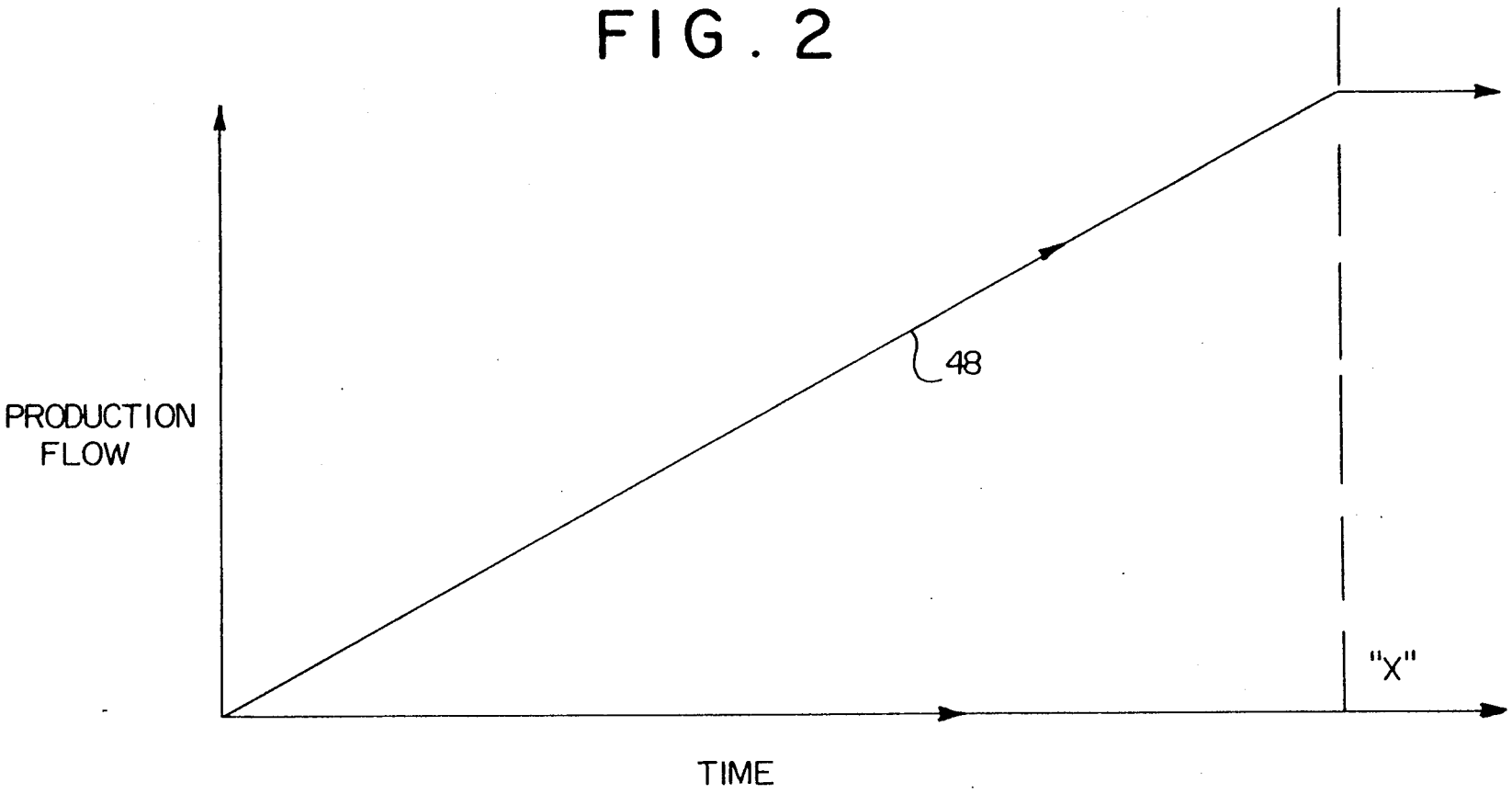
FIG. 2 is a diagram illustrating the manner in which a well outlet control choke in the well of FIG. 1 is controlled.

In FIG. 1, an oil well production casing 10 is shown as having an outer casing 12 and an inner casing 14. The inner casing 14 extends into the oil reservoir 16 from which oil containing fluid is to be recovered, for flow of the fluid up the casing 14 and thence away from the well via a suitable outlet duct 20. The outer casing 12 is connected via a duct 22 to a source 24 of pressurized gas. The inner casing 14 has apertures at suitable positions such as adjacent the base thereof for admission of gas in to the casing 14. The so admitted gas is entrained in the fluid flowing up casing 14 whereby, in accordance with conventional practice, to lessen the effective density of the fluid and to facilitate lifting of the fluid to the surface for outflow along duct 20.

Duct 20 is shown as having a valve or "choke" 28 positioned therein, this being operable to close off flow from the duct 20 or to present a controllable sized opening for flow therethrough. A vortex meter 30 is also positioned in duct 20 for measuring fluid flow rate in the duct 20, meter 30 being connected to an electronic or other controller 34 for controlling the valve 28. Thus the choke 28 may be electrically or pneumatically operated, the extent of opening of the choke being controllable in accordance with fluid pressure or electrical signal from the control device 34.

Also shown, in duct 22 is a vortex meter 40 for measuring gas flow in the duct 22, a valve 42 operable to control gas flow through the duct 22, and a controller 46, such as an electrical or pneumatic device, effective to control valve 42 in the same manner as choke 28 is controlled by controller 34.

It has been found that good results are obtained, in terms of reducing slugging, if during startup of production the flow of the gas through duct 22 is made, initially, equal to substantially the optimum anticipated flow and, preferably, maintained substantially at that rate. Starting with choke 28 closed, the choke 28 is then gradually and smoothly opened such as illustrated in the graph 2 where the plot 48 shown illustrates the manner of variation of the choke opening with time. The full choke opening may be reached over a time period "x" indicated which may be of order of 5 to 30 minutes. Thus opening of the choke may be controlled by the controller 34 by application of a ramp signal to the choke 28.

Figure 3:
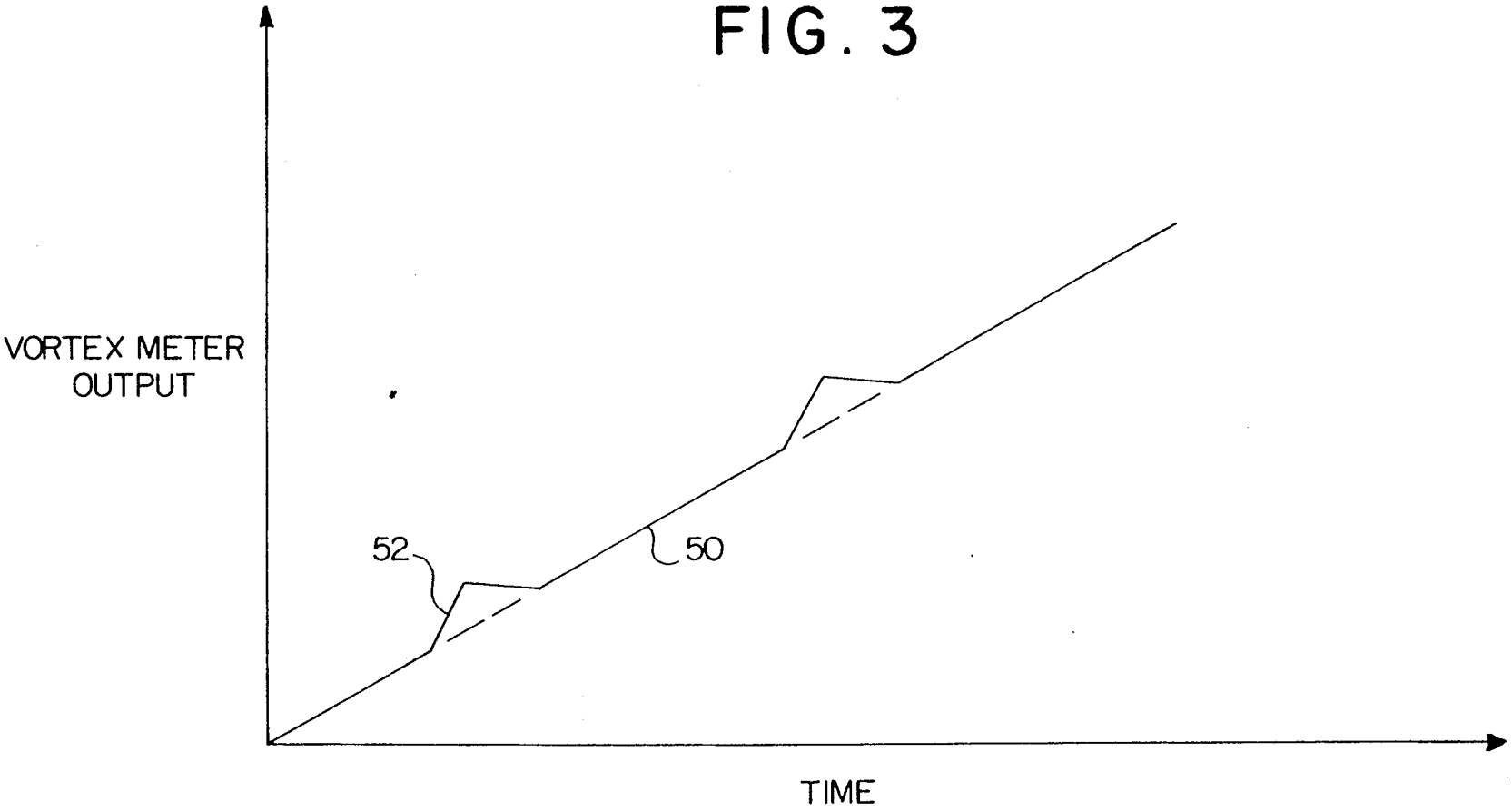
FIG. 3 is a diagram illustrating the manner of control of the well outlet control choke.

In operation, too, the flow meter 30 measures the flow rate through the duct 20 and the rate of opening of the choke 28 (i.e. the slope of the ramp signal applied thereto) is varied under control of the controller 34. More particularly, when the flow rate is found to increase at more than a predetermined rate, represented in FIG. 3 by phantom line 50 at the region 52 shown, the controller 34 is effective to reduce the rate of opening of the choke 28 whereby to tend to restore the flow rate increase to conform to the desired rate represented by line 50.

While the invention has been described with reference: to the use of vortex meters for measuring flow, other kinds of meters may be employed. However, as mentioned in Australian patent specification 30828/84, vortex meters are quite suitable for measuring mixed phase flows such as occur in the duct 30.

In a modification (not illustrated) the flow rate of the gas through the duct 22 may be varied during start-up. In particular, it may be increased in some predetermined fashion. The control of the gas flow is effected as desired by the controller 46. While the invention has been described in the context of a production start-up technique, it is also applicable to control of oil production generally. Thus, the controller 34 may act during ordinary operation of the well to decrease the flow opening therethrough under the condition of detection of increased flow by flow meter 30, or otherwise in response to detection of a condition possibly corresponding to onset of slugging.

The described arrangement has been advanced merely by way of explanation and many modifications may be made thereto without departing from the spirit and scope of the invention as defined in the appended claims.

We claim:

1. A method of startup of oil production in a continuous gas-lift oil well comprising the steps of:

injecting gas into the well fluid to be recovered to reduce its effective density so as to facilitate lifting of the fluid;

monitoring the flow rate of the fluid from the well;

progressively opening valve means controlling the fluid flow from the well; and controlling said opening of the valve means such that the rate of opening thereof is varied to reduce the rate of opening on detection of an increase in monitored flow rate which is greater than a predetermined rate, whereby to reduce the tendency for slugging.

2. A method for startup of oil production in a continuous gas-lift oil well as claimed in claim 1, wherein the inlet flow of the gas is maintained substantially constant.

3. A method for startup of oil production in a continuous gas-lift oil well as claimed in claim 1, wherein the fluid flow rate from the well is monitored by a vortex meter.

4. A method of oil production in a continuous gas-lift oil well comprising the steps of:

injecting gas into the well fluid to be recovered to reduce its effective density so as to facilitate lifting of the fluid;

monitoring the flow rate of the fluid from the well; and controlling a flow regulating device in the flow path of the fluid from the well in accordance with the monitored flow rate to reduce the flow rate when the flow rate, as monitored, is indicative of the onset of slugging.

5. A method of oil production in a continuous gas-lift oil well as claimed in claim 4, wherein said reduction in said flow rate is effected when an increase in said flow rate is detected.

6. A method of oil production in a continuous gas-lift oil well as claimed in claim 4, wherein the fluid rate from the well is monitored by a vortex meter.

* * * * *